US006983676B1

(12) United States Patent
Huang

(10) Patent No.: US 6,983,676 B1
(45) Date of Patent: Jan. 10, 2006

(54) ADJUSTABLE WRENCH

(76) Inventor: Wen-Kuo Huang, No. 53, Lane 106, Sec. 4, An Ho Road, Tainan City (TW)

( * ) Notice: Subject to any disclaimer, the term of this patent is extended or adjusted under 35 U.S.C. 154(b) by 0 days.

(21) Appl. No.: 10/911,277

(22) Filed: Aug. 4, 2004

(51) Int. Cl.
*B25B 13/00* (2006.01)
*B25B 13/46* (2006.01)

(52) U.S. Cl. ..... 81/145

(58) Field of Classification Search ..... 81/142, 81/129, 129.5, 145
See application file for complete search history.

(56) References Cited

U.S. PATENT DOCUMENTS

| | | | | | |
|---|---|---|---|---|---|
| 1,689,072 | A * | 10/1928 | Grimsrud | 81/328 |
| 1,697,291 | A * | 1/1929 | Spence | 81/129.5 |
| 2,015,895 | A * | 10/1935 | Hagbo | 81/143 |
| 2,698,549 | A * | 1/1955 | Campbell | 81/3.42 |
| 2,720,205 | A * | 10/1955 | Gunnar | 81/165 |
| 2,850,932 | A * | 9/1958 | Bonkowski | 81/145 |
| 2,948,174 | A * | 8/1960 | Bourne | 81/129 |
| 3,000,245 | A * | 9/1961 | Orr | 81/63.2 |
| 3,232,150 | A * | 2/1966 | Ailegraud | 81/143 |
| 3,358,534 | A * | 12/1967 | O'Quinn | 81/145 |
| 3,376,766 | A * | 4/1968 | Dominique | 81/138 |
| 3,983,768 | A * | 10/1976 | Smith | 81/129.5 |
| 4,106,372 | A * | 8/1978 | Miller | 81/143 |
| 4,281,568 | A * | 8/1981 | Martinmaas | 81/134 |
| 4,602,533 | A * | 7/1986 | Dunn | 81/134 |
| 4,722,254 | A * | 2/1988 | Dawkins et al. | 81/145 |
| 4,735,121 | A * | 4/1988 | Coulson | 81/129 |
| 4,833,949 | A * | 5/1989 | Piperkovski | 81/127 |
| 5,231,904 | A * | 8/1993 | Masbaum | 81/126 |
| 5,331,868 | A * | 7/1994 | Elmore | 81/165 |
| 5,568,752 | A * | 10/1996 | Alford | 81/126 |
| 5,799,550 | A * | 9/1998 | Hsieh | 81/150 |
| 5,809,852 | A * | 9/1998 | Haskell | 81/129 |
| 6,101,906 | A * | 8/2000 | Tai | 81/129 |
| 6,202,516 | B1 * | 3/2001 | Kim | 81/179 |
| 6,305,249 | B1 * | 10/2001 | Wang | 81/63 |
| 6,568,301 | B2 * | 5/2003 | Huang | 81/165 |
| 6,848,342 | B2 * | 2/2005 | Bergfeld, III | 81/153 |
| 2004/0074345 | A1 * | 4/2004 | Huang | 81/142 |

* cited by examiner

*Primary Examiner*—Joseph J. Hail, III
*Assistant Examiner*—Robert Scruggs
(74) *Attorney, Agent, or Firm*—Charles E. Baxley

(57) ABSTRACT

An adjustable wrench includes a handle having an end on which a fixed jaw is formed. The handle includes an engaging section and a transverse through-hole. A movable jaw includes a longitudinal hole through which the engaging section of the handle extends, allowing the movable jaw to slide relative to the handle. A retaining member is movably mounted in the transverse through-hole of the handle and biased by an elastic element to a position where toothed sections of the retaining member are engaged with toothed sections of the movable jaw, thereby retaining the movable jaw in place. The retaining member can be pushed to another position wherein the toothed sections of the retaining member are disengaged from the toothed sections of the movable jaw, allowing the movable jaw to slide relative to the fixed jaw.

9 Claims, 8 Drawing Sheets

ADJUSTABLE WRENCH

BACKGROUND OF THE INVENTION

1. Field of the Invention

The present invention relates to a wrench. In particular, the present invention relates to an adjustable wrench.

2. Description of the Related Art

FIG. 8 of the drawings illustrates a conventional adjustable wrench comprising a handle 1', a fixed jaw 11' formed on an end of the handle 1', a movable jaw 2', and an adjusting screw 3'. The movable jaw 2' has a bottom slidably received in a sliding groove 12' in the end of the handle 1'. The bottom of the movable jaw 2' includes a threaded section (not shown) engaged with the adjusting screw 3' that is rotatably supported in the handle 1'. When the adjusting screw 3' is turned, the movable jaw 2' slides along the sliding groove 12' and thus moves toward or away from the fixed jaw 11', adjusting the gap 4' between the fixed jaw 11' and the movable jaw 2' for clamping an object.

Nevertheless, when the movable jaw 2' has to move through a relatively long travel relative to the fixed jaw 11', the user has to turn the adjusting screw 3' many turns, which is quite inconvenient. Further, a relatively large gap exists between the screw thread of the adjusting screw 3' and the threaded section of the movable jaw 2' such that the object could not be reliably clamped. Further, when the handle 1' is turned to turn the object such as a bolt head, the bolt head is apt to be damaged.

SUMMARY OF THE INVENTION

In accordance with an aspect of the present invention, an adjustable wrench comprises a handle including a first lateral side and a second lateral side opposed to the first lateral side. A fixed jaw is formed on an end of the handle. The handle includes an engaging section and a transverse through-hole extending from the first lateral side of the handle through the second lateral side of the handle.

A movable jaw includes a longitudinal hole through which the engaging section of the handle extends, allowing the movable jaw to slide relative to the handle. The movable jaw further includes an underside having two ends. A toothed section is formed on each end of the underside of the movable jaw.

A retaining member is movably mounted in the transverse through-hole of the handle. An elastic element is mounted in the retaining member. A fixing plate is securely mounted to the second lateral side of the handle, with an end of the elastic element abutting against the fixing plate.

The retaining member is biased by the elastic element to a position where two toothed sections of the retaining member are engaged with the toothed sections of the movable jaw, thereby retaining the movable jaw in place. The retaining member can be pushed to another position wherein the toothed sections of the retaining member are disengaged from the toothed sections of the movable jaw, allowing the movable jaw to slide relative to the fixed jaw.

The toothed sections of the movable jaw and the toothed sections of the retaining member are preferably inclined to prevent the retaining member from falling out of the transverse through-hole when the toothed sections of the movable jaw are engaged with the toothed sections of the retaining member.

The retaining member includes a receptacle for receiving the elastic element. The retaining member further includes a groove defined in a side thereof. The fixing plate is partially received in the groove.

The engaging section of the handle includes two sliding grooves respectively in two lateral sides thereof. Two mutually facing walls delimiting the longitudinal hole of the movable jaw include two tracks that are respectively and slidably received in the sliding grooves.

Two mutually facing walls delimiting the transverse through-hole include two guiding grooves, and the retaining member includes two tracks that are slidably received in the guiding grooves.

The handle further includes a compartment in a bottom wall delimiting one of the sliding grooves. An abutting member is fixed to the movable jaw and extends into the compartment. Another elastic element is received in the compartment and includes a first end abutting against the abutting member and a second end abutting against an end wall that delimits the compartment. This elastic element biases the movable jaw to slide relative to the fixed jaw when the retaining member is in another position.

In an embodiment, the end wall that delimits the compartment is distal to the fixed jaw. In another embodiment, the end wall that delimits the compartment is proximate to the fixed jaw.

A stop is formed on an end of each toothed section of the movable jaw, and the retaining member abuts against the stops of the movable jaw to limit a maximum travel of the movable jaw.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
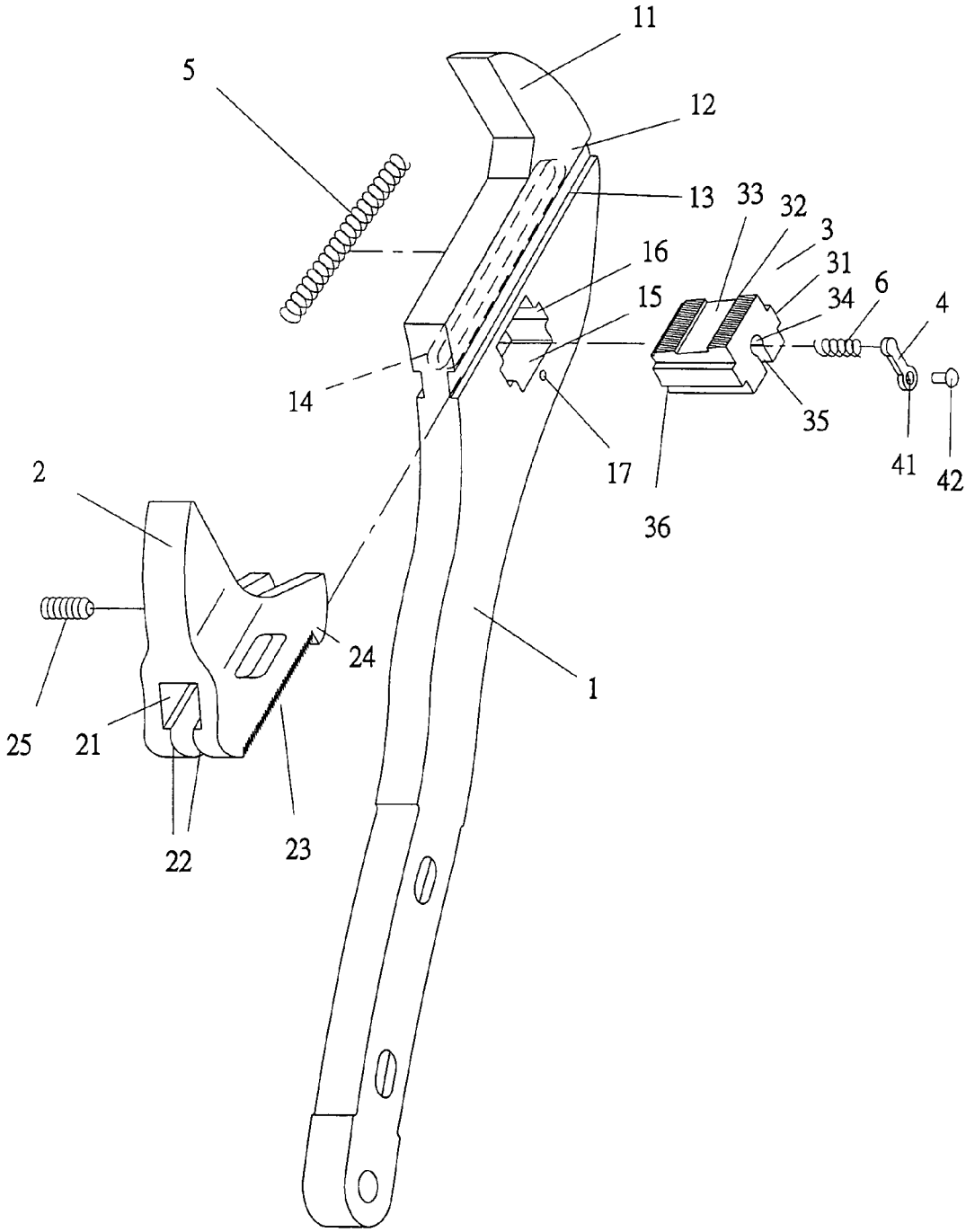
FIG. 1 is an exploded perspective view of an adjustable wrench in accordance with the present invention.
Figure 2:
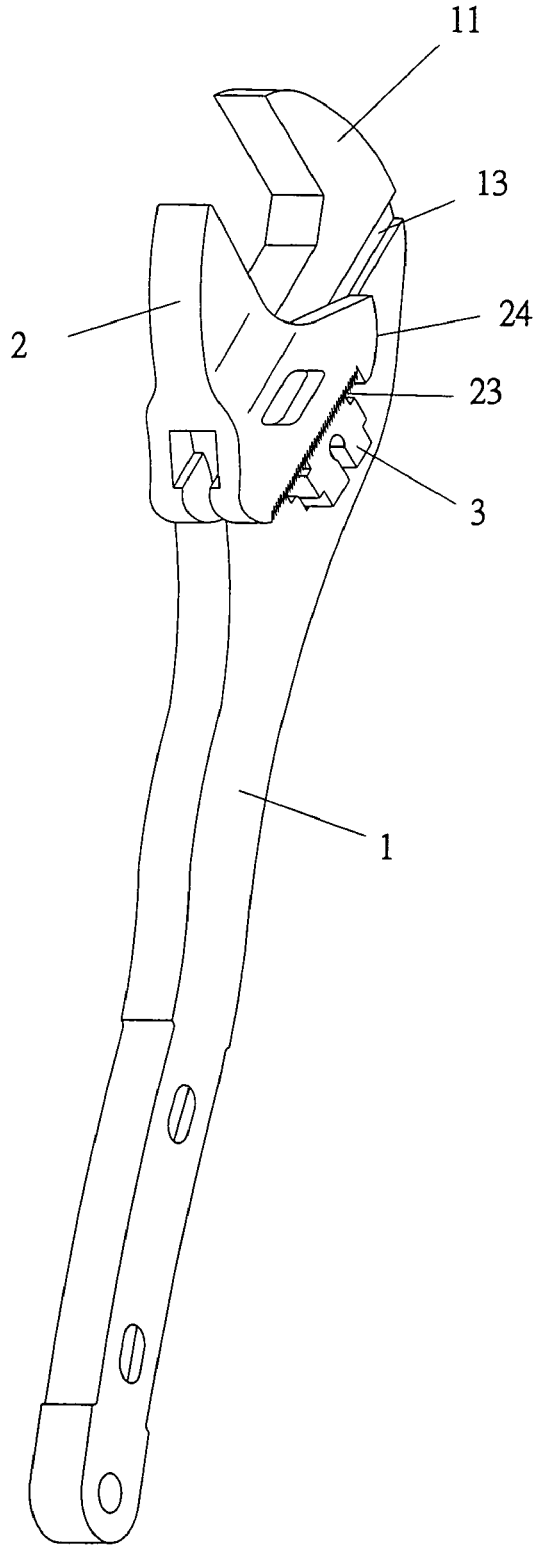
FIG. 2 is a perspective view of the adjustable wrench in accordance with the present invention.

Referring to FIGS. 1 through 4, an adjustable wrench in accordance with the present invention comprises a handle 1, a fixed jaw 11, a movable jaw 2, and a retaining member 3. The fixed jaw 11 is formed on an end of the handle 1. Below the fixed jaw 11 is an engaging section 12 including two sliding grooves 13 respectively in two opposite lateral sides thereof. A bottom wall delimiting one of the sliding grooves 13 includes a compartment 14 for accommodating an elastic element 5. The handle 1 further includes a transverse through-hole 15 located below the sliding grooves 13 and extending from a lateral side of the handle 1 through the other lateral side of the handle 1. Two mutually facing walls delimiting the transverse through-hole 15 include two guiding grooves 16. Further, the handle 1 includes a fixing hole 17 below the transverse through-hole 15.

The movable jaw 2 is slidably mounted to the engaging portion 12 of the handle 1. The movable jaw 2 includes a longitudinal hole 21 through which the engaging portion 12 of the handle 1 extends. Two mutually facing walls delimiting the longitudinal hole 21 include two tracks 22 that are respectively received in the sliding grooves 13, providing stable sliding movement of the movable jaw 2 relative to the handle 1. The movable jaw 2 further includes an inclined toothed section 23 on each of two ends of an underside thereof, with a stop 24 being formed on an end of each toothed section 23. An end of the elastic element 5 abuts against an abutting member 25 that is fixed to the movable jaw 2 and that extends into the compartment 14.

The retaining member 3 is mounted in the transverse through-hole 15 of the handle 1 and includes two tracks 31 respectively on front and rear sides thereof. Formed on two ends of an upper side of the retaining member 3 are two inclined toothed sections 32, with a recessed section 33 being formed between the inclined toothed sections 32. The retaining member 3 further includes a receptacle 34 in a lateral side of the retaining member 3 for receiving an elastic element 6. A groove 35 is defined in the lateral side of the retaining member 3 and communicated with an outer end of the receptacle 34. A push section 36 is formed on the other lateral side of the retaining member 3.

Figure 3:
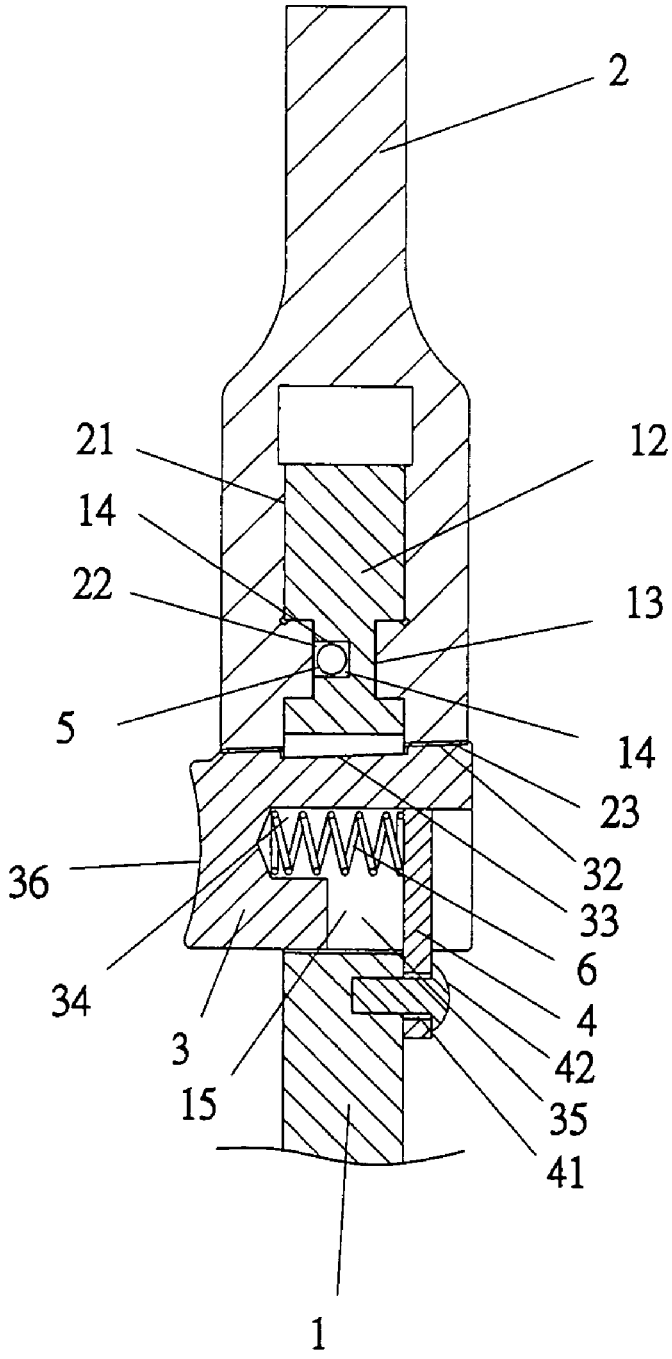
FIG. 3 is a sectional view of the adjustable wrench in accordance with the present invention.
Figure 4:
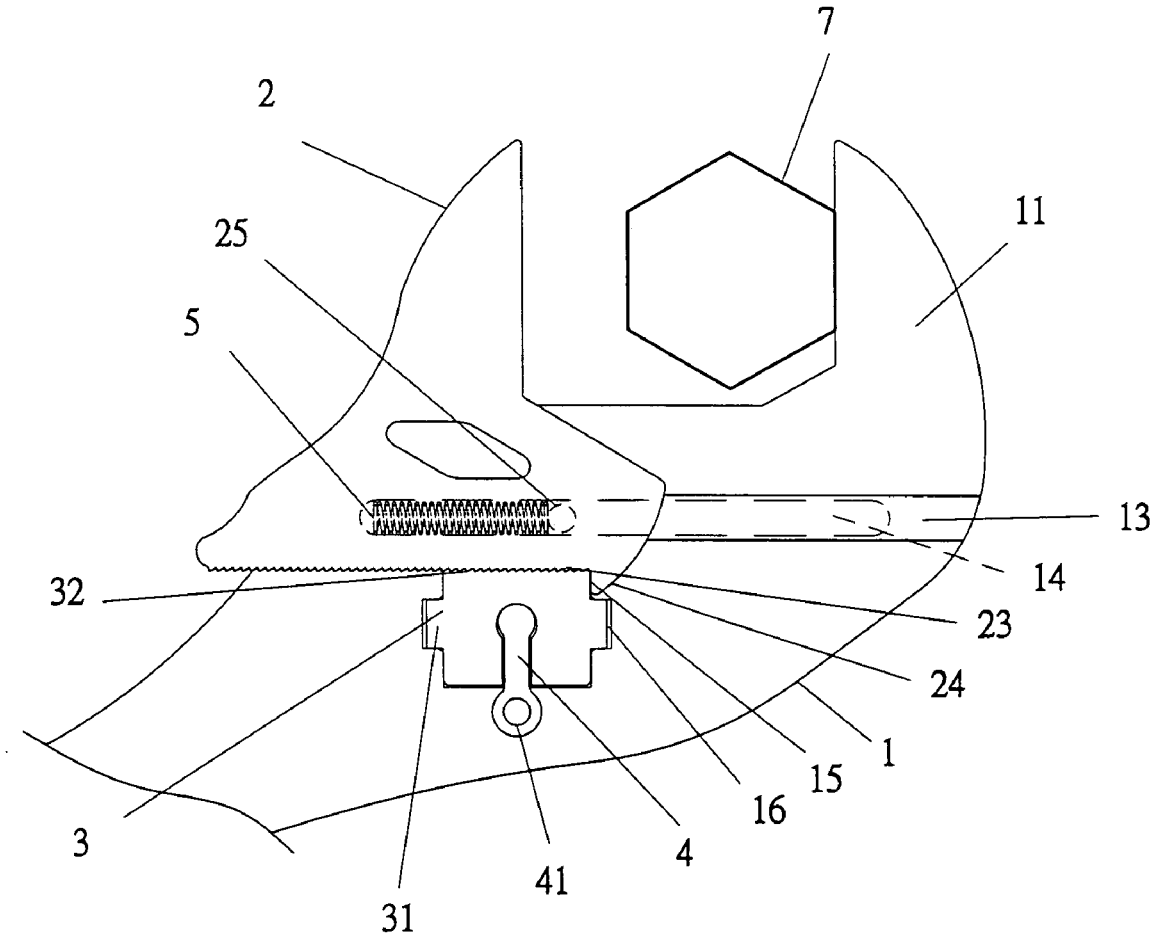
FIG. 4 is a side view of a portion of the adjustable wrench in accordance with the present invention.

Referring to FIG. 3, most part of the fixing plate 4 is received in the groove 35 of the retaining member 3 and includes an engaging hole 41 outside the groove 35. A fastener 42 is extended through the engaging hole 41 into the fixing hole 17 of the handle 1 to fix the fixing plat 4 in place. An end of the elastic element 6 abuts against the fixing plate 4, and the other end of the elastic element 6 abuts an end wall delimiting the receptacle 34 of the retaining member 4.

In assembly, the elastic element 5 is mounted into the compartment 14 of the handle 1, and the longitudinal hole 21 of the movable jaw 2 is engaged with the engaging section 12 of the handle 1, with an end of the elastic element 5 abutting against an end wall that delimits the compartment 14 and that is distal to the fixed jaw 11, and with the other end of the elastic element 5 abutting against the abutting member 25 that extends into the compartment 14. Thus, the movable jaw 2 is biased by the elastic element 5 to move toward the fixed jaw 11.

Then, the retaining member 3 is mounted into the transverse through-hole 15 of the handle 1, and the elastic element 6 is mounted into the receptacle 34. Next, the fixing plate 4 is fixed to the handle 1. The retaining member 3 is biased by the elastic element 6 to urge the toothed sections 32 of the retaining member 3 to engage with the toothed sections 23 of the movable jaw 2. Since the toothed sections 32 and 23 are inclined, the retaining member 3 can be retained in place and disengagement of the retaining member 3 can be prevented. Further, the retaining member 3 abuts against the stops 24 of the movable jaw 2 to limit the maximum travel of the movable jaw 2.

Figure 5:
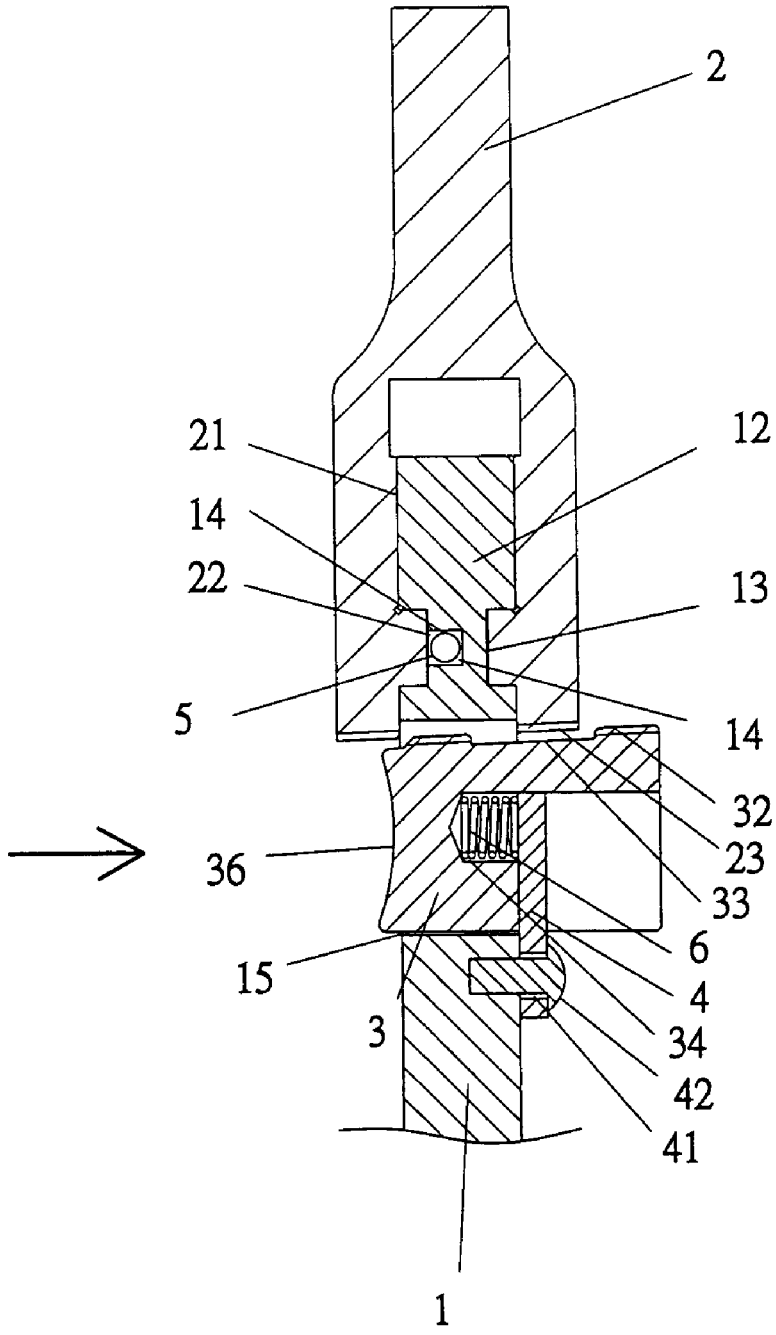
FIG. 5 is a view similar to FIG. 3, wherein a retaining member is pushed away from a retaining position.
Figure 6:
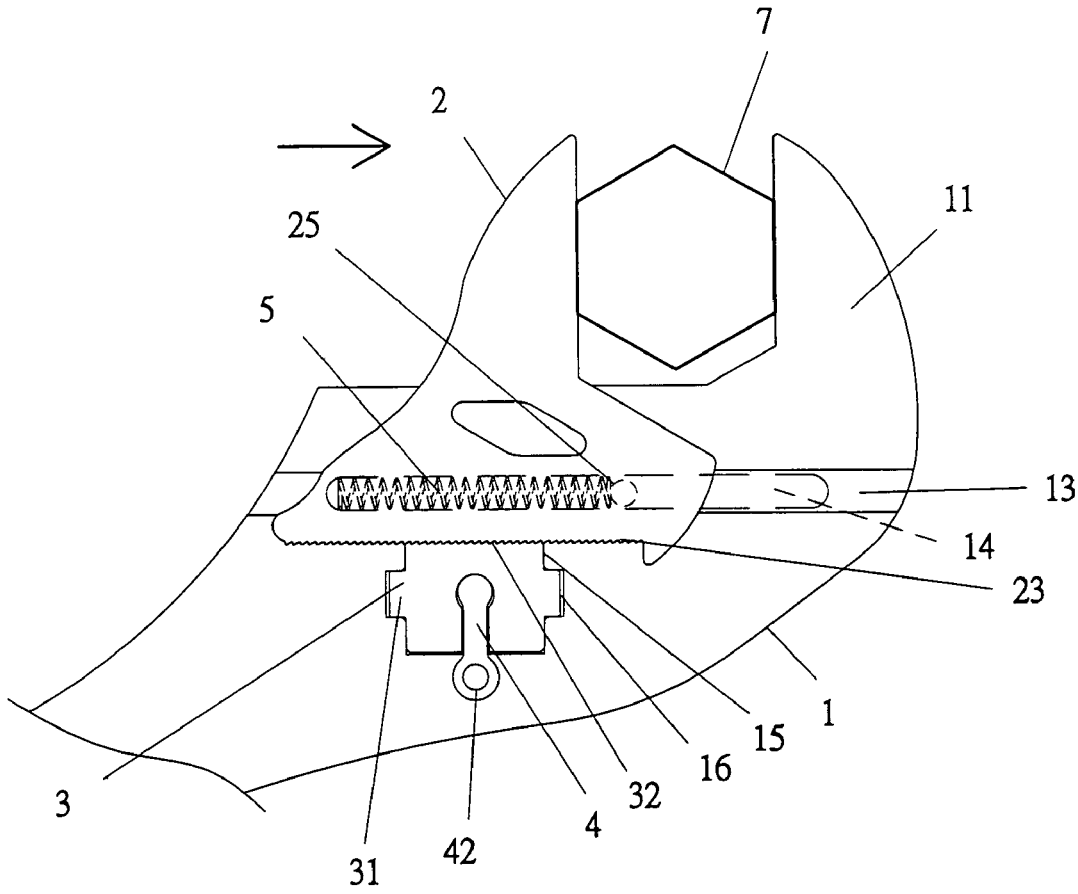
FIG. 6 is a view similar to FIG. 4, illustrating automatic clamping of the adjustable wrench.

Referring to FIG. 5, when the user presses the push section 36 of the retaining member 3, the retaining member 3 is moved such that the toothed sections 32 of the retaining member 3 disengage from the toothed sections 23 of the movable jaw 2 and that the toothed sections 23 of the movable jaw 2 are aligned with the recessed section 33 of the retaining member 3 allowing the movable jaw 2 to move toward or away from the fixed jaw 11. The movable jaw 2 can be moved toward the fixed jaw 11 under the action of the elastic element 5, thereby automatically clamping an object, such as a bolt head 7, as shown in FIG. 6.

After adjustment, the retaining member 3 is released, and the retaining member 3 returns to its original position under the action of the elastic element 6. The toothed sections 32 of the retaining member 3 are engaged with the toothed sections 23 of the movable jaw 2 (see FIG. 2), providing improved engagement while providing improved torque for the adjustable wrench.

Figure 7:
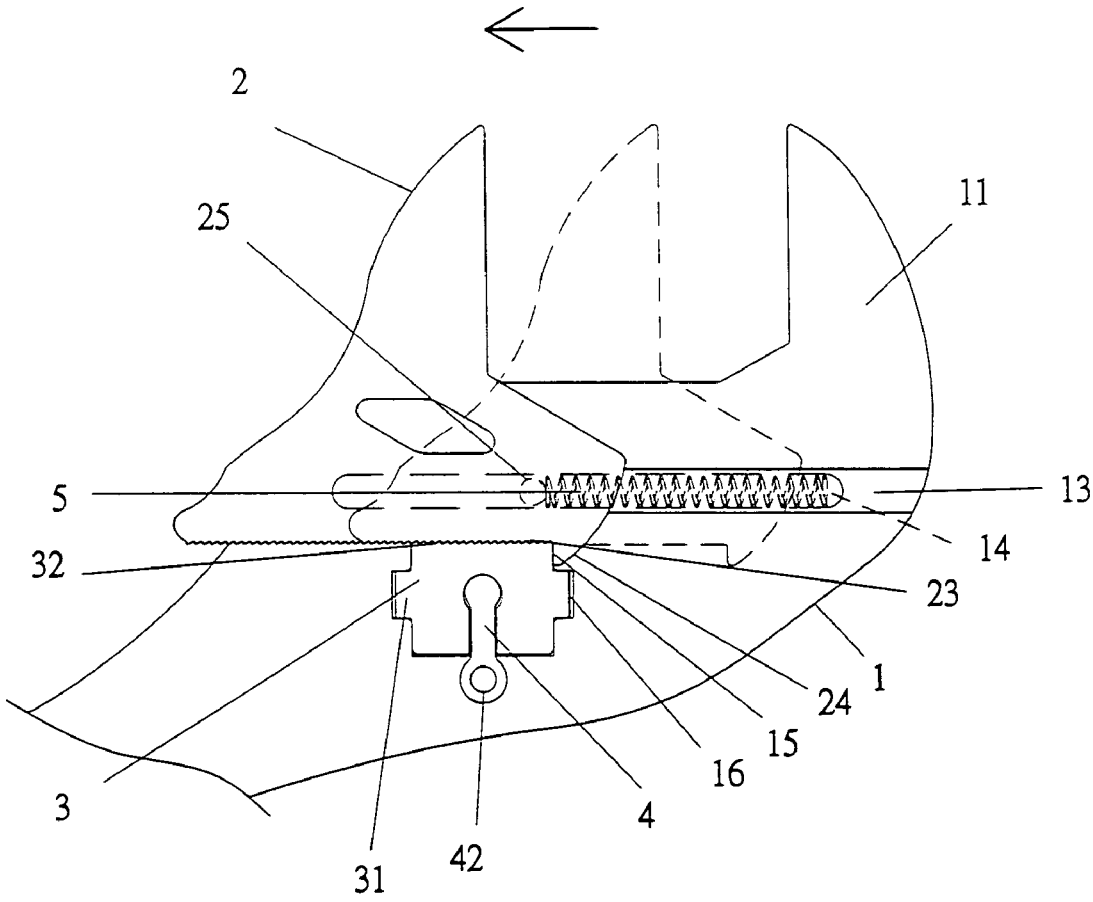
FIG. 7 is a side view similar to FIG. 4, illustrating a modified embodiment of the present invention.
Figure 8:
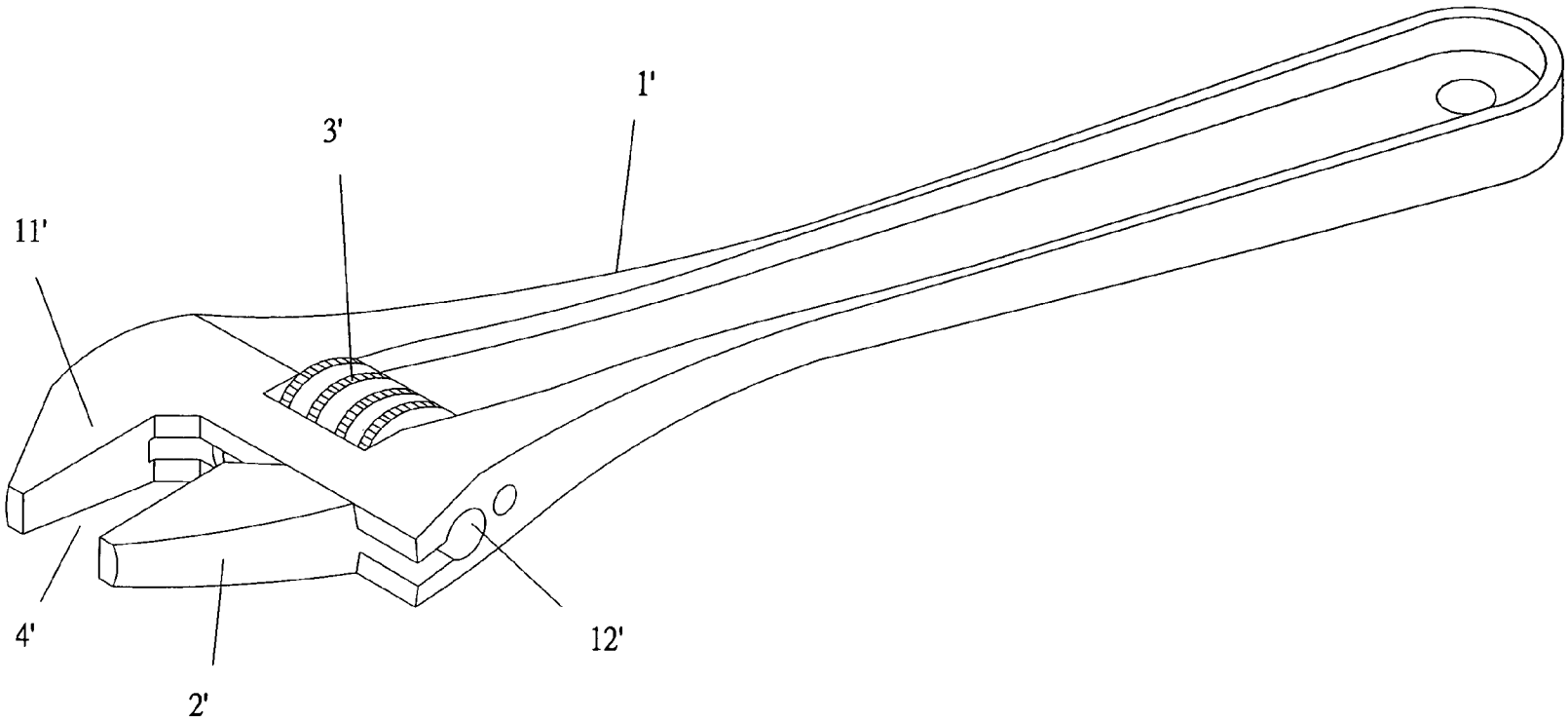
FIG. 8 (PRIOR ART)
FIG. 8 is a perspective view of a conventional adjustable wrench

FIG. 7 shows another embodiment of the invention, wherein an end of the elastic element 5 abuts against the other end wall that delimits the compartment 14 and that is proximate to the fixed jaw 11. In this embodiment, when the retaining member 3 is pushed to allow adjustment of the distance between the movable jaw 2 and the fixed jaw 3, the movable jaw 2 is moved away from the fixed jaw 3 under the action of the elastic element 5 without any manual operation.

Although specific embodiments have been illustrated and described, numerous modifications and variations are still possible without departing from the essence of the invention. The scope of the invention is limited by the accompanying claims.

What is claimed is:

1. An adjustable wrench comprising:

a handle including a first lateral side and a second lateral side opposed to the first lateral side, a fixed jaw being formed on an end of the handle, the handle including an engaging section, the handle further including a transverse through-hole extending from the first lateral side of the handle through the second lateral side of the handle;

a movable jaw including a longitudinal hole through which the engaging section of the handle extends, allowing the movable jaw to slide relative to the handle, the movable jaw further including an underside having two ends, a toothed section being formed on each said end of the underside of the movable jaw;

a retaining member movably mounted in the transverse through-hole of the handle, the retaining member including an elastic element mounted therein, the retaining member further including two toothed sections;

a fixing plate securely mounted to the second lateral side of the handle, with an end of the elastic element abutting against the fixing plate;

the retaining member being biased by the elastic element to a position where the toothed sections of the retaining member are engaged with the toothed sections of the movable jaw, thereby retaining the movable jaw in place;

the retaining member being pushable to another position wherein the toothed sections of the retaining member are disengaged from the toothed sections of the movable jaw, allowing the movable jaw to slide relative to the fixed jaw.

2. The adjusting wrench as claimed in claim 1 wherein the toothed sections of the movable jaw and the toothed sections of the retaining member are inclined to prevent the retaining member from falling out of the transverse through-hole when the toothed sections of the movable jaw are engaged with the toothed sections of the retaining member.

3. The adjustable wrench as claimed in claim 1 wherein the retaining member includes a receptacle for receiving the elastic element, the retaining member further including a groove defined in a side thereof, the fixing plate being partially received in the groove.

4. The adjustable wrench as claimed in claim 1 wherein the engaging section of the handle includes two sliding grooves respectively in two lateral sides thereof, two mutually facing walls delimiting the longitudinal hole of the movable jaw including two tracks that are respectively and slidably received in the sliding grooves.

5. The adjustable wrench as claimed in claim 4 wherein the handle further includes a compartment in a bottom wall delimiting one of the sliding grooves, an abutting member being fixed to the movable jaw and extending into the compartment, another elastic element being received in the compartment and including a first end abutting against the abutting member and a second end abutting against an end wall that delimits the compartment, said another elastic element biasing the movable jaw to slide relative to the fixed jaw when the retaining member is in said another position.

6. The adjustable wrench as claimed in claim 5 wherein said end wall that delimits the compartment is distal to the fixed jaw.

7. The adjustable wrench as claimed in claim 5 wherein said end wall that delimits the compartment is proximate to the fixed jaw.

8. The adjustable wrench as claimed in claim 1 wherein two mutually facing walls delimiting the transverse through-hole including two guiding grooves, and wherein the retaining member includes two tracks that are slidably received in the guiding grooves.

9. The adjustable wrench as claimed in claim 1 wherein a stop is formed on an end of each said toothed section of the movable jaw, and wherein the retaining member abuts against the stops of the movable jaw to limit a maximum travel of the movable jaw.

* * * * *